US011006713B2

(12) United States Patent
King

(10) Patent No.: US 11,006,713 B2
(45) Date of Patent: May 18, 2021

(54) WALLET

(71) Applicant: TRAYVAX ENTERPRISES LLC, Bellilngham, WA (US)

(72) Inventor: Mark King, Bellingham, WA (US)

(73) Assignee: TRAYVAX ENTERPRISES LLC, Bellingham, WA (US)

( * ) Notice: Subject to any disclaimer, the term of this patent is extended or adjusted under 35 U.S.C. 154(b) by 298 days.

(21) Appl. No.: 15/999,080

(22) Filed: Aug. 17, 2018

(65) Prior Publication Data

US 2018/0368544 A1 Dec. 27, 2018

Related U.S. Application Data

(63) Continuation of application No. 15/251,304, filed on Aug. 30, 2016, now Pat. No. 10,080,409.

(60) Provisional application No. 62/212,363, filed on Aug. 31, 2015.

(51) Int. Cl.
*A45C 1/06* (2006.01)
*A45C 11/18* (2006.01)

(52) U.S. Cl.
CPC ..... *A45C 1/06* (2013.01); *A45C 11/182* (2013.01); *A45C 2001/067* (2013.01); *A45C 2011/186* (2013.01)

(58) Field of Classification Search
CPC ..... A45C 2011/186; A45C 1/06; A45C 2001/0067; A45C 11/182; A45C 2001/065
USPC ..... 150/147; 206/39, 39.7
See application file for complete search history.

(56) References Cited

U.S. PATENT DOCUMENTS

| | | | |
|---|---|---|---|
| 956,534 | A | 5/1910 | Lahey |
| D189,333 | S | 11/1960 | Hayden |
| 3,970,129 | A | 7/1976 | Tepfer |
| D314,865 | S | 2/1991 | Tuisku |
| D377,713 | S | 2/1997 | Chandler |
| 5,944,080 | A | 8/1999 | Podwika |
| 6,357,084 | B1 | 3/2002 | Haidon |
| D527,898 | S | 9/2006 | Travone |
| D553,354 | S | 10/2007 | Kohler |
| D574,614 | S | 8/2008 | Sanders |

(Continued)

OTHER PUBLICATIONS

Trayvax Original Wallet [online image]. Retrieved from Kickstarter website May 7, 2013 at https://www.kickstarter.com/projects/1262752680/trayvax-wallet-for-life.

(Continued)

*Primary Examiner* — Sue A Weaver
(74) *Attorney, Agent, or Firm* — FisherBroyles, LLP; Susan M. Oiler

(57) ABSTRACT

A wallet including a plate and a strap attached to the plate is provided. The strap has a first end, a central portion, and a second end. The plate is shaped as a frame defining an opening and defining an anchoring slot, and a lacing region defining a plurality of lacing slots is suspended within the opening by one or more connectors. The first end of the strap is anchored to the plate through the anchoring slot, the central portion of the strap extends around plate, and the second end of the strap is laced through the lacing slots to secure the strap to the plate, which defines an interior compartment between the strap and the plate. Contents of the wallet are positioned between the central portion of the strap and the plate and are held in place by tightening the second end of the strap.

16 Claims, 10 Drawing Sheets

(56) References Cited

U.S. PATENT DOCUMENTS

| | | | |
|---|---|---|---|
| D575,506 | S | 8/2008 | Huang |
| D584,049 | S | 1/2009 | Uzelac |
| D590,151 | S | 4/2009 | Karobkina |
| D611,249 | S | 3/2010 | Uzelac |
| D616,295 | S | 5/2010 | Britt |
| D620,252 | S | 7/2010 | Keels |
| D622,958 | S | 9/2010 | Moore |
| D628,796 | S | 12/2010 | Uzelac |
| D630,848 | S | 1/2011 | Long et al. |
| D632,076 | S | 2/2011 | Westrick |
| D638,624 | S | 5/2011 | Lyons |
| D650,581 | S | 12/2011 | Wallace |
| D663,951 | S | 7/2012 | Flores |
| D687,630 | S | 8/2013 | Warner |
| D688,865 | S | 9/2013 | Tsai |
| D690,931 | S | 10/2013 | Minn |
| D694,007 | S | 11/2013 | D'Amore |
| D705,210 | S | 5/2014 | Adelman et al. |
| D706,536 | S | 6/2014 | Nikosey |
| D713,143 | S | 9/2014 | Ashley |
| D716,043 | S | 10/2014 | Wilk |
| D718,525 | S | 12/2014 | Kim |
| D723,798 | S | 3/2015 | Sha |
| D724,840 | S | 3/2015 | Fridstrom |
| D724,841 | S | 3/2015 | Schneider |
| 9,125,464 | B2 | 9/2015 | Minn et al. |
| 9,314,074 | B2 | 4/2016 | Johnson et al. |
| D775,824 | S | 1/2017 | King |
| 10,080,409 | B2 * | 9/2018 | King ..... A45C 1/06 |
| 10,512,316 | B2 * | 12/2019 | Haarburger ..... A45C 1/06 |
| 2005/0279435 | A1 | 12/2005 | Coates |
| 2009/0020570 | A1 | 1/2009 | Chan |
| 2017/0119115 | A1 | 5/2017 | King |

OTHER PUBLICATIONS

"Trayvax, Wallet for Life." Kick Finder, Showing the Best of Kickstarter. Jun. 8, 2013. Web. <https://kickinitforward.wordpress.com/2013/06/08/trayvax-wallet-for-life/>.

Trayvax Original Wallet, Front View [image], corresponding to wallet distributed on Oct. 31, 2013, via https://www.kickstarter.com/projects/1262752680/trayvax-wallet-for-life/posts/647452.

Trayvax Original Wallet, Back View [image], corresponding to wallet distributed on Oct. 31, 2013, via https://www.kickstarter.com/projects/1262752680/trayvax-wallet-for-life/posts/647452.

Trayvax Original Wallet, Top View [image], corresponding to wallet distributed on Oct. 31, 2013, via https://www.kickstarter.com/projects/1262752680/trayvax-wallet-for-life/posts/647452.

Trayvax Original Wallet, Open View [image], corresponding to wallet distributed on Oct. 31, 2013, via https://www.kickstarter.com/projects/1262752680/trayvax-wallet-for-life/posts/647452.

Design U.S. Appl. No. 29/538,029, filed Aug. 31, 2015, now U.S. Pat. No. D. 775,824, issued Jan. 10, 2017, inventor Mark King.

U.S. Appl. No. 15/335,099, filed Oct. 26, 2016, now U.S. Pat. No. 10,126,596, issued Nov. 13, 2018, inventor Mark King.

* cited by examiner

WALLET

CROSS REFERENCE TO RELATED APPLICATIONS

This application is a continuation of U.S. application Ser. No. 15/251,304, filed Aug. 30, 2016, which claims the benefit of U.S. Provisional Application No. 62/212,363 filed Aug. 31, 2015, which is incorporated herein by reference in its entirety.

TECHNICAL FIELD

The present disclosure relates generally to a wallet, and more particularly to a durable and low profile utility wallet for carrying personal items.

BACKGROUND

Traditional billfolds or wallets, which usually include bi-folds or tri-folds of leather, canvas, nylon, or other material, are usually bulky. When stuffed with credit cards, money, receipts, or other personal items, traditional wallets become even thicker and hard to carry. And when carried in a rear pocket, for example, sitting on such a large, bulky wallet can be uncomfortable. Sitting on such large, bulky wallets can even cause back problems in some users. Such bulky wallets are also hard to carry in a front pocket as well because of their size.

In addition to being bulky, traditional wallets made of leather or canvas, for example, tend to wear out over time. If the wear on a wallet becomes significant, the wallet may no longer securely hold the personal items of its owner.

A need thus exists for a thin, low profile wallet that is both durable and easy to carry. A need also exists for a lightweight wallet.

SUMMARY

In certain example aspects described herein, a wallet is provided, such as a utility wallet. The wallet includes a strap having a first end, a central portion, and a second end. The wallet also includes a rigid plate to which the strap attaches. That is, the rigid plate is constructed to interface with the strap so as to hold objects such as personal items. The rigid plate includes a substantially flat body having an anchoring slot, the anchoring slot being constructed so as to secure the first end of the strap to the body of the rigid plate. The rigid plate also includes a recessed region. The recessed region is spaced from the horizontal plane of the substantially flat body of the rigid plate. The recessed region, for example, defines one or more lacing slots that are constructed to receive the second end of the strap. The central portion of the strap, for example, extends around the front of the rigid plate. The second end of the strap is secured to the rigid body by lacing the second end of the strap through the plurality of lacing slots. In certain example aspects, the utility wallet includes a right sidewall and a top sidewall.

In use, the central portion of the strap can extend upwards from the bottom of the wallet and around the front of the wallet, including around any contents of the wallet. By pulling on the second end of the strap that extends through the lacing slots, a user can adjust the length of the strap and thereby tighten or loosen the strap. For example, a user can tighten the strap to more firmly securing any personal items against the rigid plate. If the user needs to add personal items to the wallet, for example, the user can loosen the strap, add the items, and then tighten the strap against the personal items and the rigid support.

These and other aspects, objects, features, and advantages of the example embodiments will become apparent to those having ordinary skill in the art upon consideration of the following detailed description of illustrated example embodiments. Additional advantages of the invention will be set forth in part in the description which follows, and in part will be obvious from the description, or may be learned by practice of the invention. The advantages of the invention will be realized and attained by means of the elements and combinations particularly pointed out in the appended claims. It is to be understood that both the foregoing general description and the following detailed description are exemplary and explanatory only and are not restrictive of the invention, as claimed.

DETAILED DESCRIPTION

Figure 1:
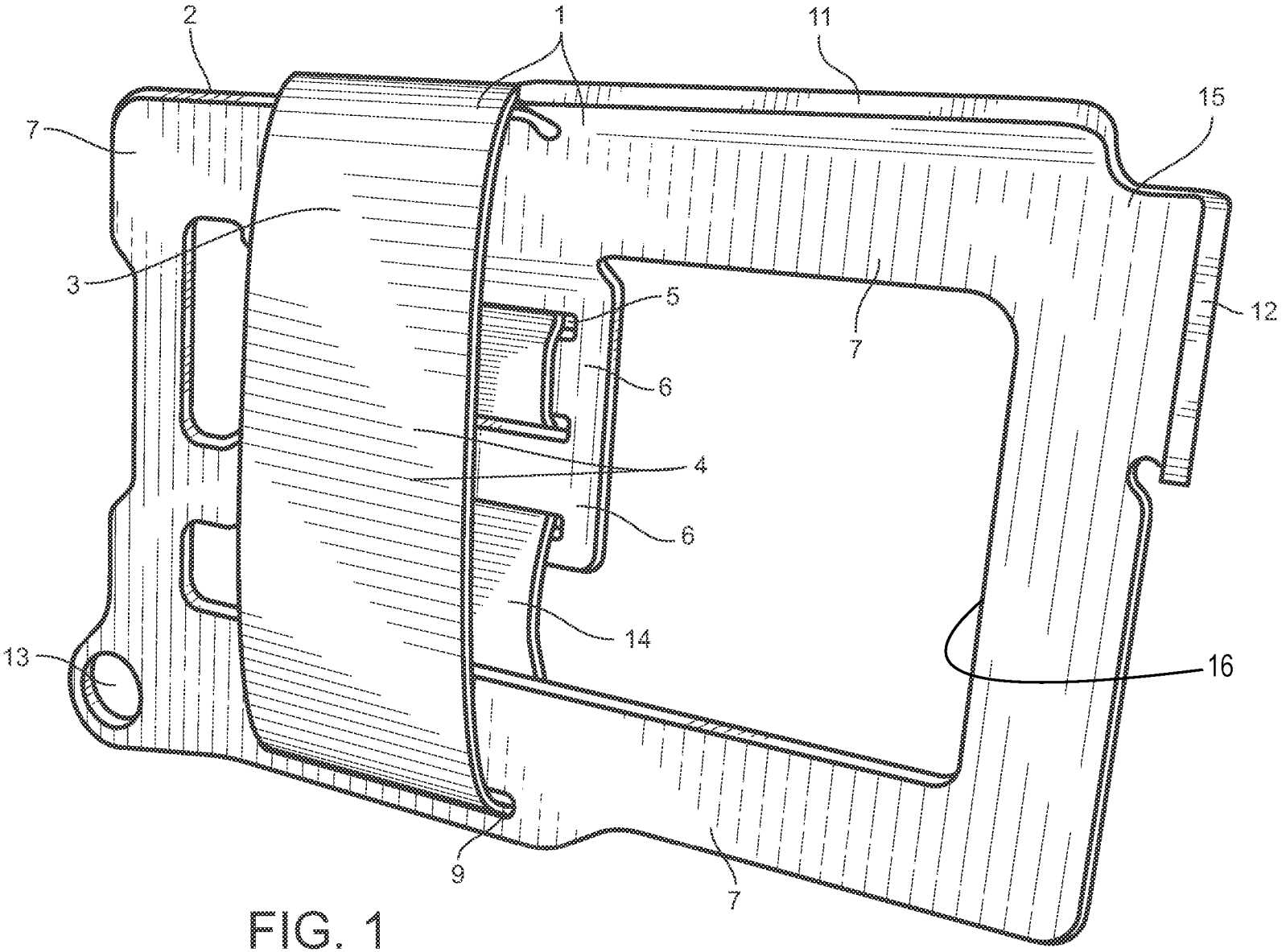
FIG. 1 is a front right perspective view of the wallet, in accordance with certain example embodiments.
Figure 2:
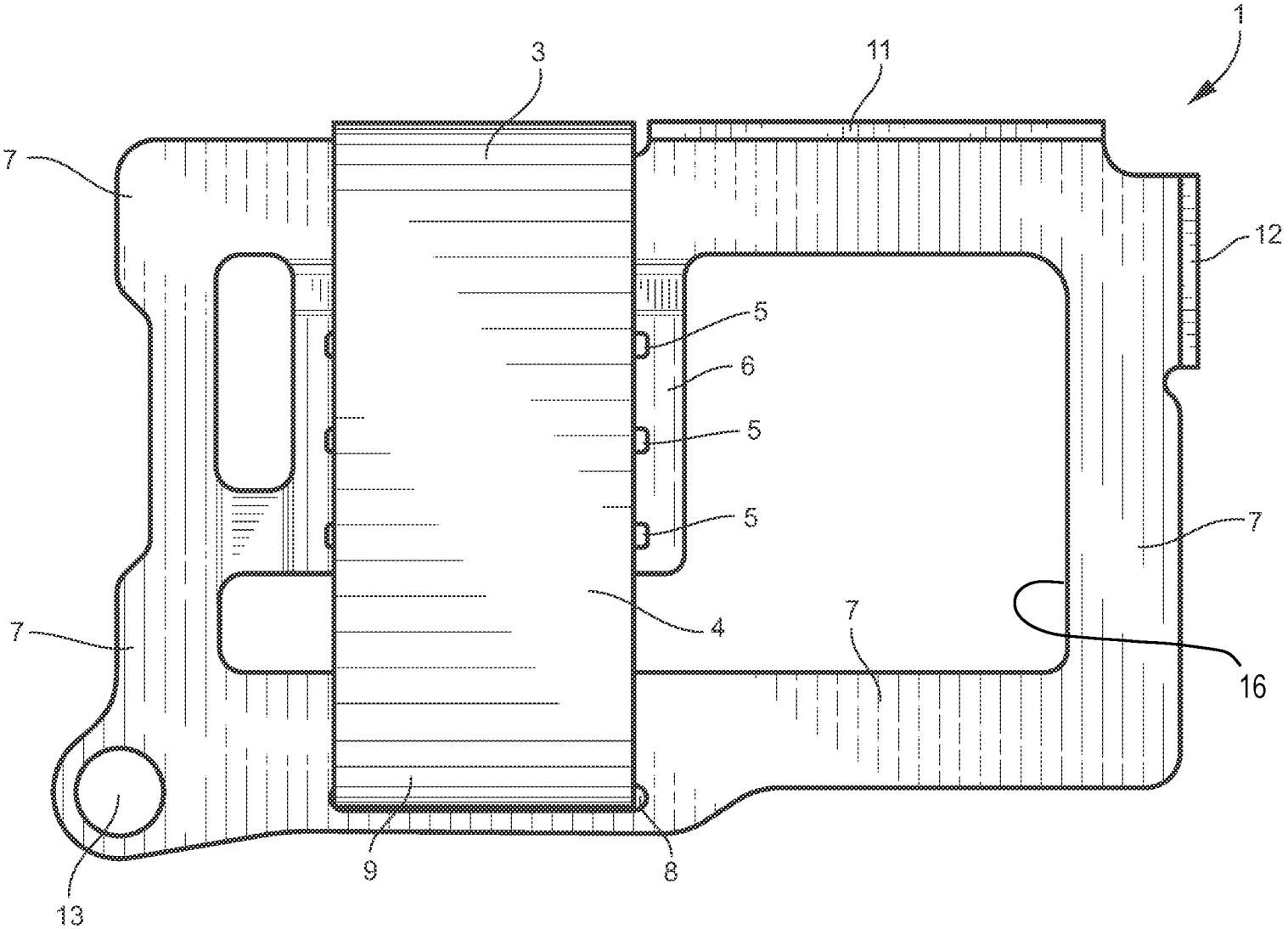
FIG. 2 is a front elevational view of the wallet, in accordance with certain example embodiments.
Figure 3:
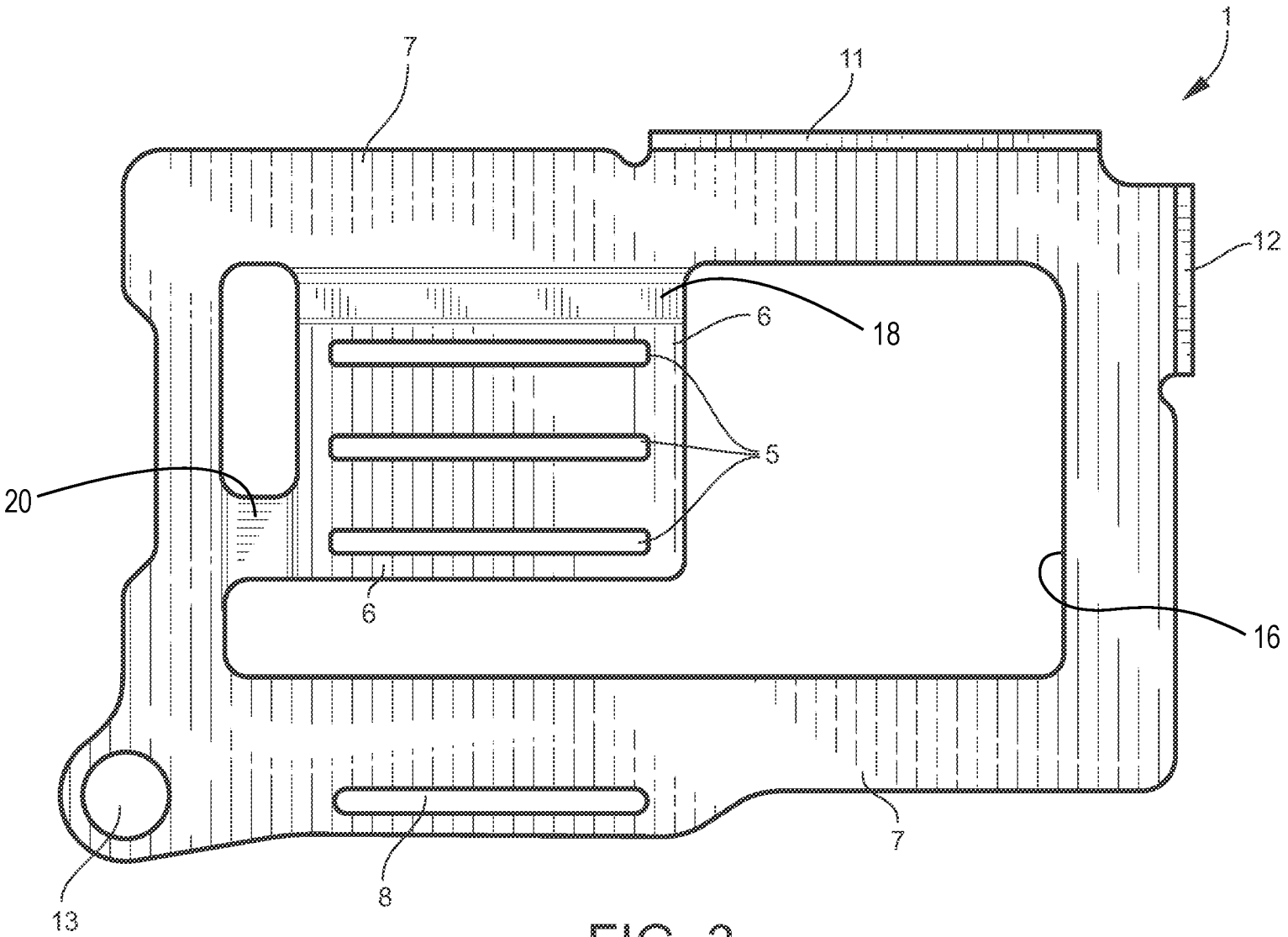
FIG. 3 is a front elevational view of a rigid plate portion of the wallet, in accordance with certain example embodiments.
Figure 4:
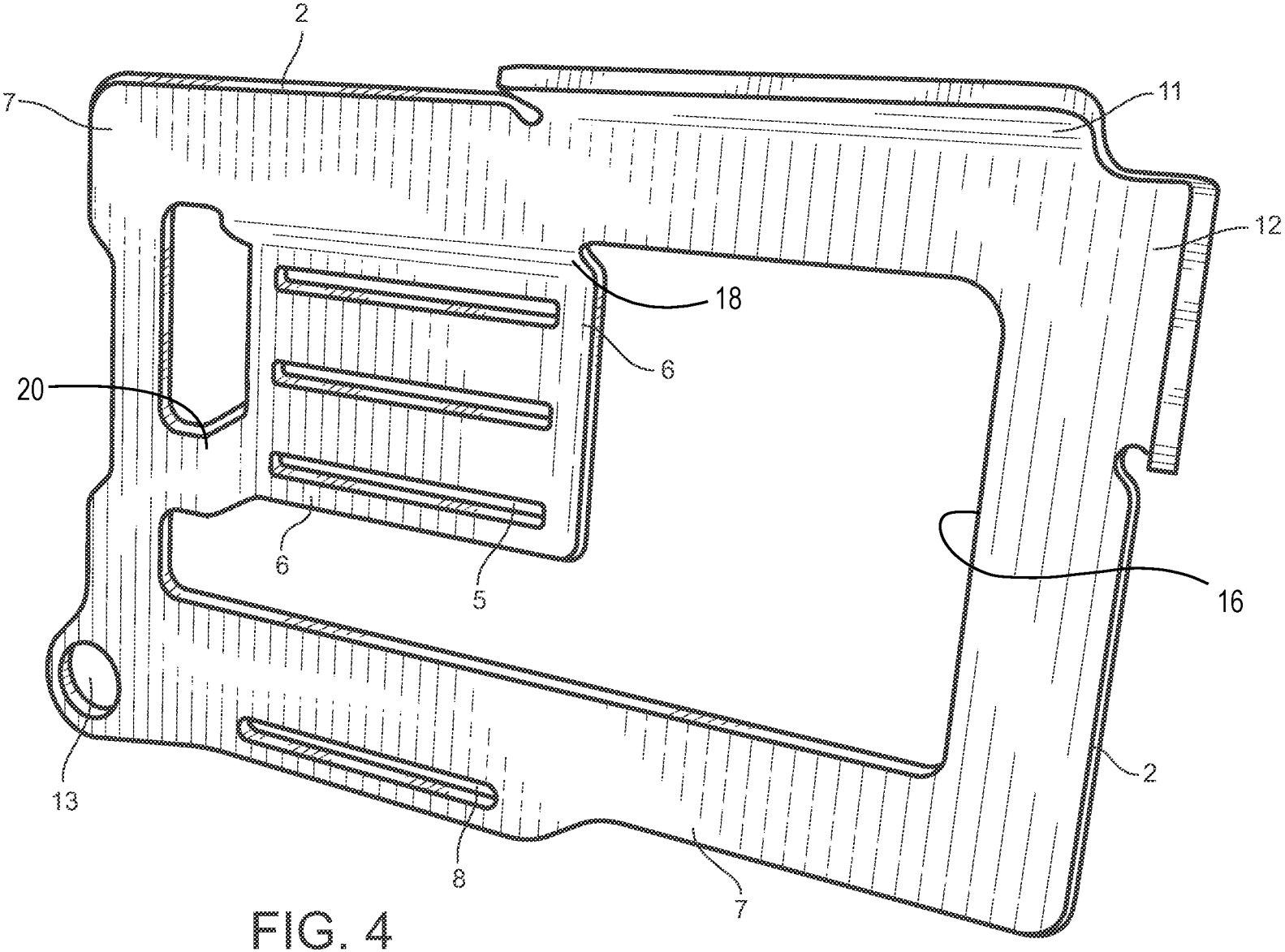
FIG. 4 is a front right perspective view of the rigid plate portion of the wallet, in accordance with certain example embodiments.
Figure 5:
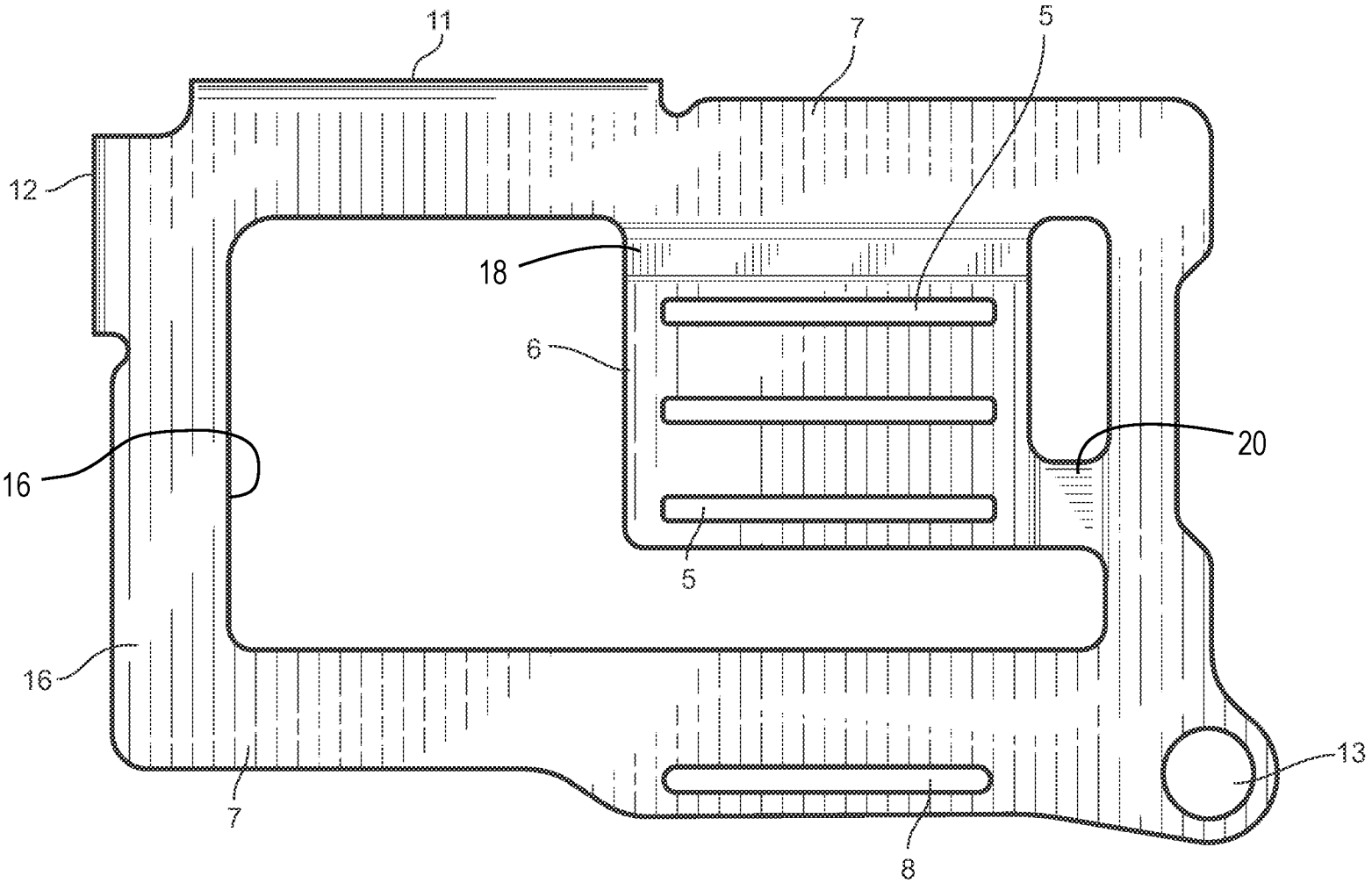
FIG. 5 is a rear elevational view of the rigid plate portion of the wallet, in accordance with certain example embodiments.
Figure 6:
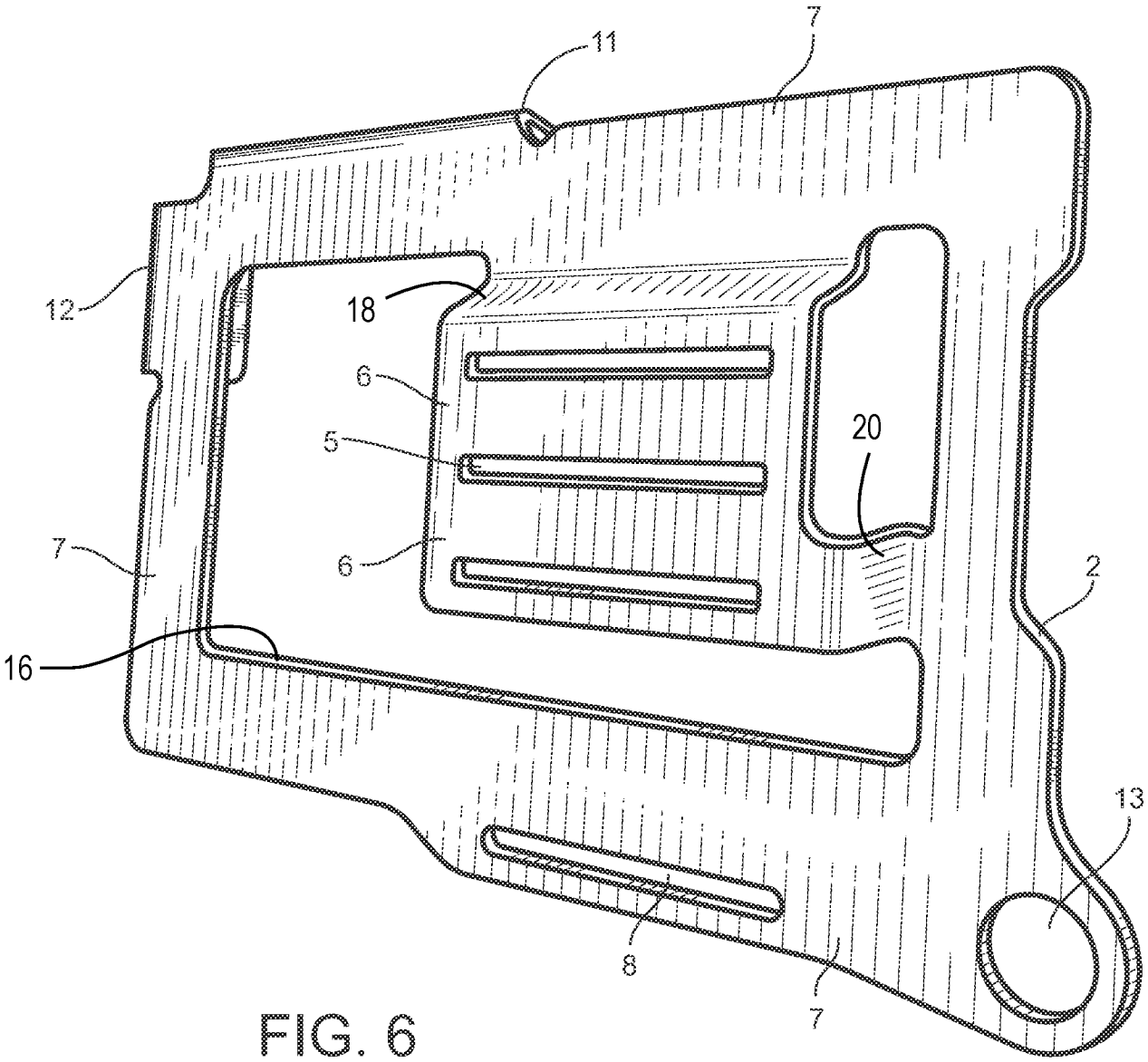
FIG. 6 is a rear left side perspective view of the rigid plate portion of the wallet, in accordance with certain example embodiments.
Figures 7, 8, 9, 10:
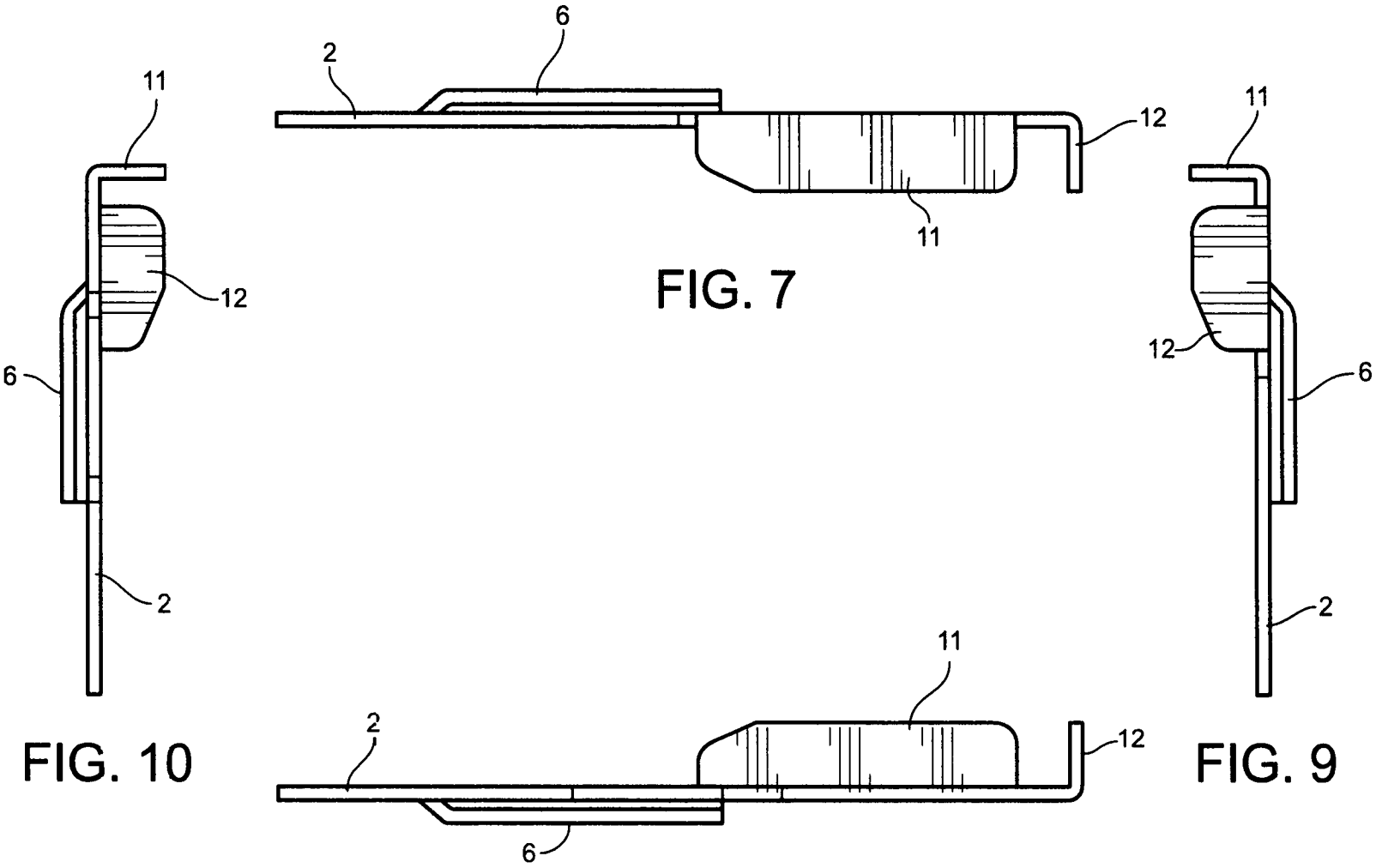
FIG. 7 is a top plan view of the rigid plate portion of the wallet, in accordance with certain example embodiments.
FIG. 8 is a bottom elevational view of the rigid plate portion of the wallet, in accordance with certain example embodiments.
FIG. 9 is a right side elevational view of the rigid plate portion of the wallet, in accordance with certain example embodiments.
FIG. 10 is a left side elevational view of the rigid plate portion of the wallet, in accordance with certain example embodiments.
Figure 11:
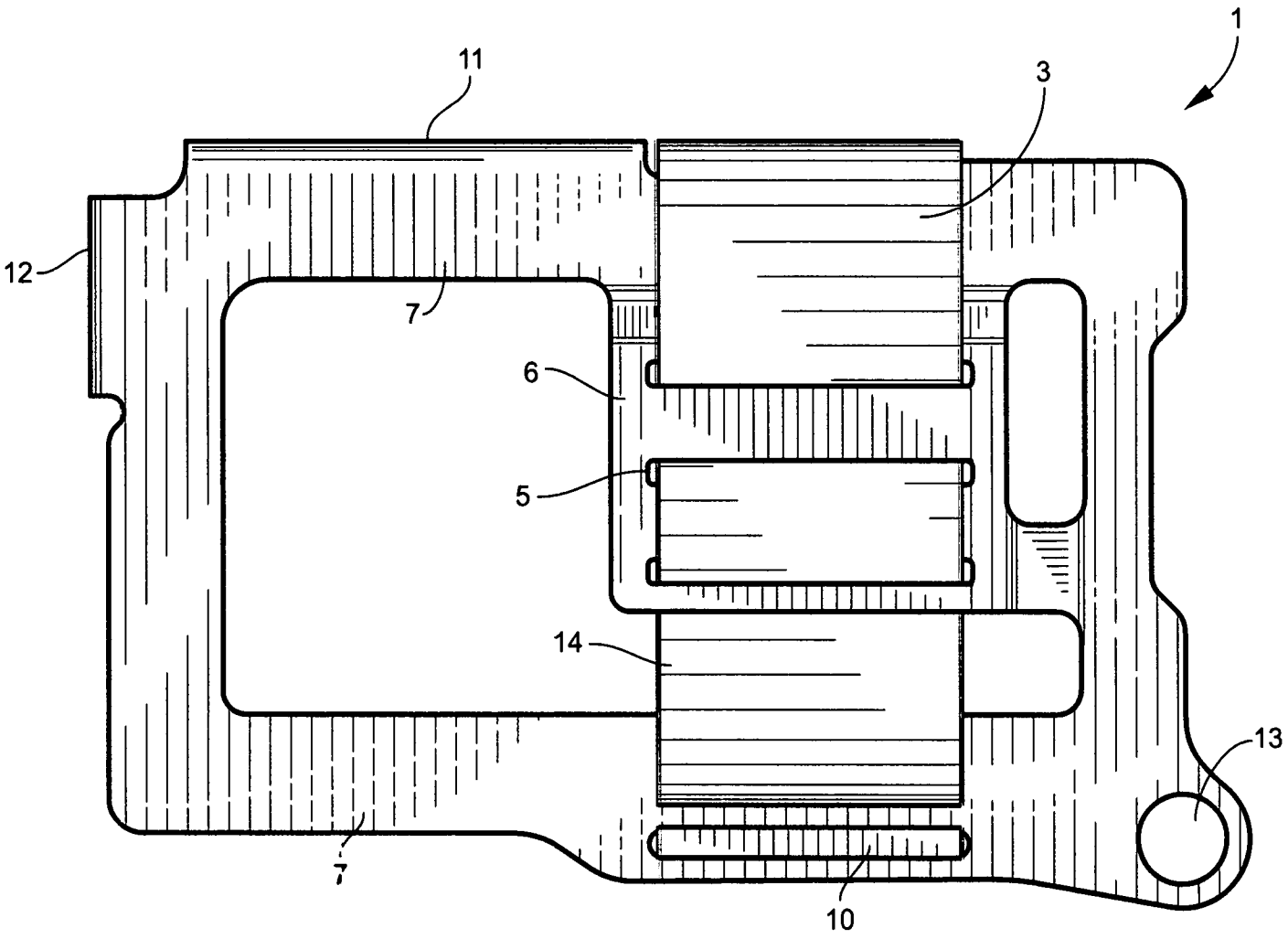
FIG. 11 is a rear elevational view of the wallet, in accordance with certain example embodiments.
Figure 12:
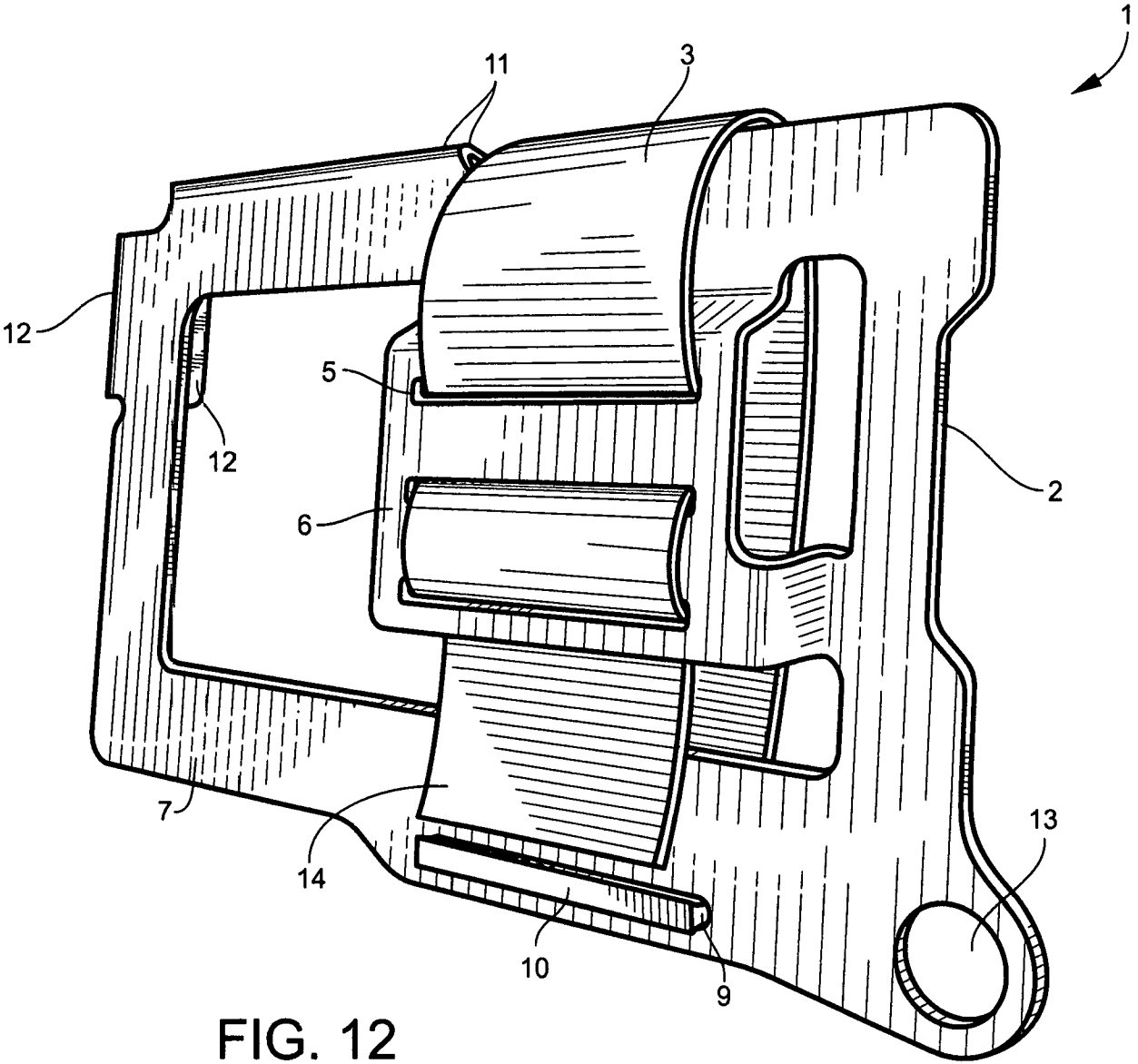
FIG. 12 is a rear left perspective view of the wallet, in accordance with certain example embodiments.
Figure 15:
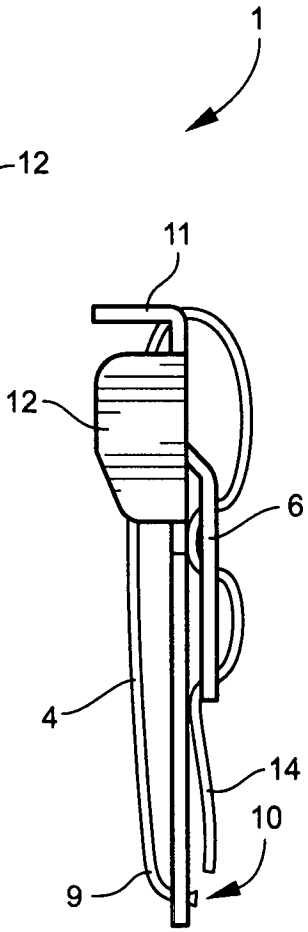
FIG. 15 is a right side elevational view of the wallet, in accordance with certain example embodiments.
Figure 13:
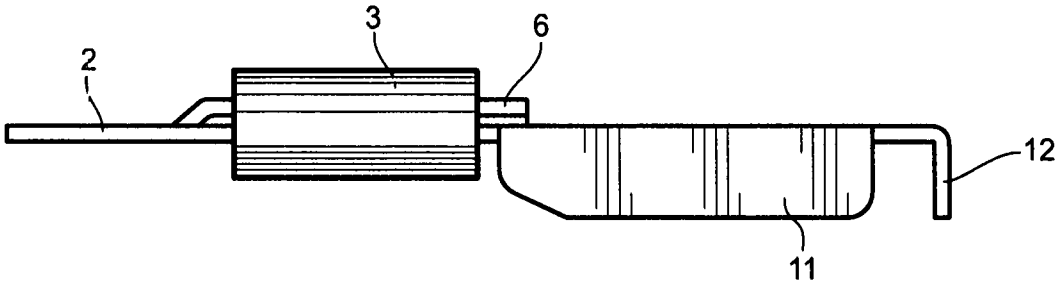
FIG. 13 is a top plan view of the wallet, in accordance with certain example embodiments.
Figure 14:
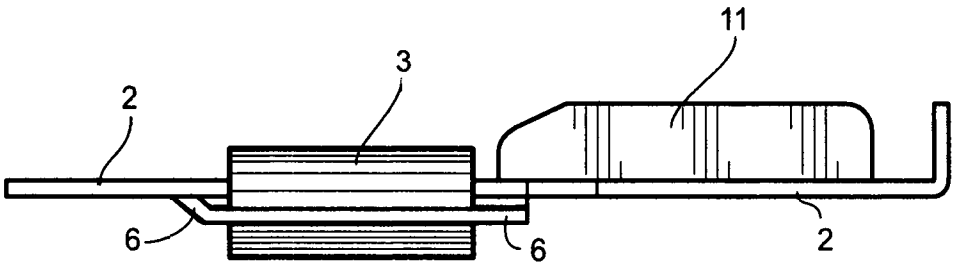
FIG. 14 is a bottom view of the wallet, in accordance with certain example embodiments.
Figure 16:
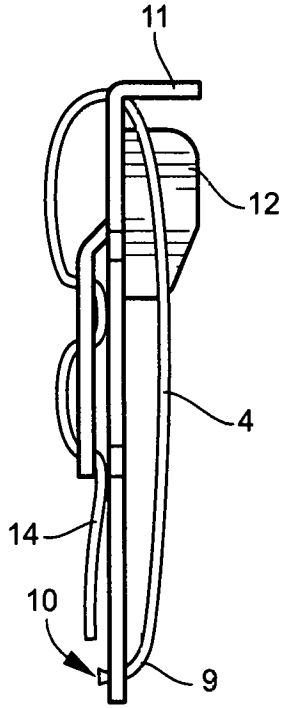
FIG. 16 is a left side elevational view of the wallet, in accordance with certain example embodiments.

The following description and drawings are illustrative and are not to be construed as limiting. Numerous specific details are described to provide a thorough understanding of the disclosure. However, in certain instances, well-known or conventional details are not described in order to avoid obscuring the description. References to one or another embodiment in the present disclosure can be, but not necessarily are, references to the same embodiment; and, such references mean at least one of the embodiments.

Reference in this specification to "one embodiment" or "an embodiment" means that a particular feature, structure, or characteristic described in connection with the embodiment is included in at least one embodiment of the disclosure. Appearances of the phrase "in one embodiment" in various places in the specification do not necessarily refer to the same embodiment, nor are separate or alternative embodiments mutually exclusive of other embodiments. Moreover, various features are described which may be exhibited by some embodiments and not by others. Similarly, various requirements are described which may be requirements for some embodiments but not other embodiments.

The terms used in this specification generally have their ordinary meanings in the art, within the context of the disclosure, and in the specific context where each term is used. Certain terms that are used to describe the disclosure are discussed below, or elsewhere in the specification, to provide additional guidance to the practitioner regarding the description of the disclosure. For convenience, certain terms may be highlighted, for example using italics and/or quotation marks. The use of highlighting has no influence on the scope and meaning of a term; the scope and meaning of a term is the same, in the same context, whether or not it is highlighted. It will be appreciated that the same thing can be said in more than one way.

Consequently, alternative language and synonyms may be used for any one or more of the terms discussed herein. Nor is any special significance to be placed upon whether or not a term is elaborated or discussed herein. Synonyms for certain terms are provided. A recital of one or more synonyms does not exclude the use of other synonyms. The use of examples anywhere in this specification including examples of any terms discussed herein is illustrative only, and is not intended to further limit the scope and meaning of the disclosure or of any exemplified term. Likewise, the disclosure is not limited to various embodiments given in this specification.

Without intent to further limit the scope of the disclosure, examples of instruments, apparatus, methods and their related results according to the embodiments of the present disclosure are given below. Note that titles or subtitles may be used in the examples for convenience of a reader, which in no way should limit the scope of the disclosure. Unless otherwise defined, all technical and scientific terms used herein have the same meaning as commonly understood by one of ordinary skill in the art to which this disclosure pertains. In the case of conflict, the present document, including definitions, will control.

It will be appreciated that terms such as "front," "back," "top," "bottom," "side," "short," "long," "up," "down," and "below" used herein are merely for ease of description and refer to the orientation of the components as shown in the figures. It should be understood that any orientation of the components described herein is within the scope of the present invention.

Overview

As disclosed herein, a wallet includes a strap that can be substantially flat and a plate. The strap can be, for example, formed from a non-elastic material. The plate can be a rigid plate and includes a substantially flat body that, for example, provides a support or backing for the wallet, and is designed to accommodate personal items of a user, such as credit cards, identifications cards, or other items. The substantially flat body of the rigid plate also includes a recessed region that, for example, allows the wallet to accommodate other personal items of the user, such as folded paper bills, receipts, or other folded papers. So as to at least partially secure items within the wallet, the wallet includes, for example, one or more sidewalls, such as a top, bottom, left, or right sidewall.

Personal items of the user can also be secured within the wallet and against the rigid plate by the substantially flat strap. For example, the substantially flat strap can be anchored to the wallet by extending one end of the substantially flat strap through an anchoring slot located on the body of the rigid plate. The substantially flat strap then can extend upwards from the bottom of the wallet and around the front of the wallet, including around any contents of the wallet. The other end of the strap can then be woven or laced, for example, through lacing slots on the rear of the wallet. By pulling on the end of the substantially flat, non-elastic strap that extends through the lacing slots, a user can adjust the length of the substantially flat strap and thereby tighten or loosen the strap. For example, a user may tighten the strap, thereby more firmly securing any personal items against the rigid plate. If the user needs to add personal items to the wallet, for example, the user may loosen the strap, add the items, and then tighten the strap against the personal items and the rigid support. The rigid plate, for example, provides support for tightening the strap against the contents of the wallet. Further, the configuration of the lacing slots allows, for example, the substantially flat strap to stay in a tightened or loosened position until the user adjusts the strap. These and other example embodiments are discussed in more detail herein.

Example Embodiments

Unless otherwise noted, technical terms are used according to conventional usage. As used herein, the singular forms "a," "an," and "the," refer to both the singular as well as plural, unless the context clearly indicates otherwise. The abbreviation, "e.g." is derived from the Latin exempli gratia, and is used herein to indicate a non-limiting example. Thus, the abbreviation "e.g." is synonymous with the term "for example." As used herein, the term "comprises" means "includes."

With reference to FIGS. 1-16, provided is a wallet 1 that includes a plate 2 and a strap 3. In one embodiment, the plate can be a rigid plate while in others, the plate can be flexible. In another embodiment, the strap can be a substantially flat strap while in others, the strap need not be substantially flat. The strap can have a first end, an opposed second end and a central portion extending therebetween. As shown, the central portion 4 of the strap 3 can wrap upwards and around the front of the rigid plate 2 and over the top of the wallet 1 (FIG. 1). The strap 3 then can wrap downwards through a series of lacing slots 5, the lacing slots 5 being located on a recessed region 6 of the rigid plate 2 (FIGS. 1, 12, and 15-16). As such, the substantially flat strap 3 interfaces with the rigid plate 2.

The strap 3 may be made of any fabric or material, including synthetic polymers such as nylon. In certain example embodiments, the strap may be non-elastic but still flexible, whereas in other embodiments the strap may be an elastic strap. That is, in one embodiment, the strap 3 can be formed from a non-elastic material such as nylon webbing and the like. In certain example embodiments, the strap may include other components, such as buckles, claps, or grommets. For example, the central portion of the strap 3 may include a buckle. As a substantially flat strap 3, the strap can have a flat and rectangular cross-sectional shape and an elongated rectangular top profile. Such a configuration, for example, allows the strap to apply a more-even compressive force when tightened around personal items of the user.

The plate 2 of the wallet 1 includes a substantially flat body 7 defining an interior opening 18, and having a front side 15 and an opposed rear side 16. That is, the rigid plate 2 is a relatively flat component of the wallet 1, the rigidity of which can provide a support or frame for the wallet 1 so that tightening the strap 3, as described herein, secures personal items of the user against the front side 15 of the rigid plate 2 of the wallet 1. As a "rigid" plate, the plate can have limited flexibility, inasmuch as the plate resists bending and deformation. As such, the rigid plate 2 is substantially stiff and inflexible, such that the rigid plate 2 can withstand tightening of the strap 3 as described herein.

As those skilled in the art will appreciate, the plate 2 may be constructed of a variety of substantially rigid materials, such as metal, a metal alloy, wood, hard polymer such as a hard plastic, carbon fibers, or other substantially rigid material or combinations thereof. For example, the rigid plate 2 may be constructed of steel, aluminum, brass, or combinations thereof. In certain example embodiments, such as when a lightweight wallet 1 is desired, the rigid plate 2 may be constructed of aluminum or other lightweight metal. In certain example embodiments, the rigid plate 2 may be painted or powder coated. By using a rigid plate 2, such as a metal plate, the wallet 1 as described herein can be a durable wallet 1.

The recessed region 6 of the rigid plate 2 can be recessed relative to the front side 15 of the rigid plate 2. That is, the recessed region 6 can extend rearward from the horizontal plane of the front side of the rigid plate 2 by connectors 18, 20, thereby forming an area of the rigid plate 2 that is depressed relative to the substantially flat body 7 of the rigid plate 2. Optionally, at least a portion of the recessed region 6 can be spaced from the rear side 16 of the plate a predetermined distance. In another embodiment, at least a portion of the recessed region can be positioned in a plane substantially parallel to the front side 15 of the plate 2.

In certain example embodiments, a series of lacing slots 5 can be defined in the recessed region 6 of the rigid plate 2. The lacing slots 5 can, for example, run parallel to a long axis of the rigid plate 2 of the wallet 1, and can be configured to receive a portion of the strap 3. As described herein, for example, a lacing end 14 of the lacing strap 3 can lace in and out of the lacing slots 5, such as in a weaving pattern, so that the lacing of the strap 3 secures the lacing end 14 of the strap 3 to the recessed region 6 of the rigid plate 2 (FIGS. 1-2, 11-12, and 15-16).

In certain example embodiments, the rigid plate 2 also includes an anchoring slot 8 defined in the plate. The anchoring slot 8, for example, can be configured to accommodate a first of end the strap 3 that is to be anchored to the rigid plate, i.e., an anchoring end 9 of the substantially flat strap. That is, the anchoring slot 8 can be used to attach the anchoring end 9 of the strap 3 to the rigid plate 2. For example, the anchoring end 9 of the strap 3 passes through the anchoring slot 8 and can be anchored to the plate 2, such as by increasing the thickness the strap 3 on a leading edge 10 of the anchoring end 9 of the strap 3 that has passed through the anchoring slot 8 (e.g., FIGS. 11-12 and 15-16). If the strap is a polymer-based strap, for example, the leading edge 10 of the anchoring end 9 of the strap 3 may be passed through the anchoring slot 8 and then melted so that the leading edge 10 of the anchoring end 9 is wider than the anchoring slot 8.

In certain example embodiments, other means may be used to increase the thickness of the leading edge 10 of the strap 3 that has passed through the anchoring slot 8, such as folding the anchoring end 9 upon itself and securing the folded portion with stitching or adhesive. By making the anchoring end 9 of the strap 3 wider and/or thicker than the width and/or thickness of the anchoring slot 8 of the rigid plate 2, the anchoring end of the strap 3 cannot pass back through the anchoring slot 8. In other example embodiments, the anchoring end 9 of the substantially flat strap 3 may be anchored to the rigid plate 2 by a fastening means, such as a cap, snap, clasp, hook, stitching, Velcro, button, or other means or fastener that may or may not also require an anchoring slot 8. For example, the anchoring end 9 may be passed through the anchoring slot 8, and then a cap can be attached to the anchoring end 9, thereby preventing the anchoring end 9 from slipping back through the anchoring slot 8. That is, the cap can be arranged so as to anchor the anchoring end 9 of the strap 3 to the rigid plate 2 via the anchoring slot 8.

In certain example embodiments, the plate 2 may include one or more sidewalls. That is, the substantially flat body 7 of the rigid plate 2 may transition, at one or more edges, into one or more portions of the rigid plate that extend outward from the flat plane of the substantially flat body 7 of the rigid plate 2. For example, the rigid plate 2 may further comprise at least one of a top sidewall 11 and a right sidewall 12. In certain example embodiments, the rigid plate 2 may include other walls, such as a left sidewall (not shown) and a bottom sidewall (not shown). The one or more sidewalls can be arranged, for example, so as to aid in further securing personal items within the wallet 1. For example, the one or more sidewalls may prevent personal items of the user from sliding out of the wallet 1 when such items are secured within the wallet 1.

As shown, the top sidewall 11 and the right sidewall 12 extend outward from the front side 15 of the substantially flat body 7 of the rigid plate 2 a predetermined distance. In one embodiment, the top sidewall, the right sidewall, the left sidewall and/or the bottom sidewall can extend outward from the front side of the substantially flat body 7 at a substantially right angle relative to the front side 15. Optionally, in another embodiment, the top sidewall 11, the right sidewall 12, the left sidewall and/or the bottom sidewall can extend outward from the front side of the substantially flat body 7 at an acute angle relative to the front side 15 of the substantially flat body.

In certain example embodiments, the sidewalls of the rigid plate 2 may be of varying length. For example, the top sidewall 11 may run along all or a portion of the long (horizontal) axis of the top of the rigid plate 2. Hence, in certain example embodiments, such as when the top sidewall 11 extends along the length of the top of the rigid plate, the substantially flat strap 3 may extend over the top sidewall 11. Similarly, in certain example embodiments the right sidewall 12 may run along all or a portion of the side (vertical) axis of the right side of the rigid plate 2.

The one or more sidewalls, for example, also form at least part of the boundary of an interior compartment of the wallet 1, within which the user may place personal items. For example, the interior compartment of the wallet 1 may be bound by at least one of a front surface of the recessed region 6, the one or more sidewalls, and the central portion 4 of the strap 3. The length and width of the interior compartment, for example, may be slightly larger than the length and width of a traditional credit card or personal identification card, thereby accommodating a traditional credit card. The depth of the interior compartment, for example, can be adjustable as described herein based on how tight the user adjusts the strap.

In certain example embodiments, the user may store paper money in the interior compartment and credit cards and other personal cards on top of the money, with the credit cards being held in place on the edges by one or more sidewalls and across the top by a portion of the substantially flat strap 3. For example, a user may place folded money in the interior compartment adjacent to the recessed region 6. The user may then place a first credit card in the compartment of the wallet 1, with the face of the first credit card resting roughly flush against the front side 15 of the substantially flat body 7 of the rigid plate 2. A user may then place additional cards on top of the first card. To secure the money and cards within the compartment of the wallet 1, the user can adjust the length of the strap 3 as described herein.

In certain example embodiments, the wallet 1 as described herein may include other features. For example, the rigid plate 2 of the wallet 1 may include an open ring 13 that can be used for a variety of purposes. A user may use the open ring 13, for example, to attach the rigid plate 2 of the wallet 1 to the user's keys, backpack, purse, or other belongings of the user. In certain example embodiments, the rigid plate may be equipped with a bottle opener or a serrated edge (not shown).

FIGS. 7-10 show the top, bottom, right, and left views of the rigid plate 2 portion of the wallet 1, respectively, in accordance with certain example embodiments. As shown, and consistent with the example embodiments described herein, the rigid plate 2 includes a substantially flat body 7 that transitions into one or more sidewalls, such as a top sidewall 11 and a right sidewall 12. The rigid plate 2 also includes, for example, the recessed region 6 that is spaced from the rear side 16 of the rigid plate 2.

As shown in FIGS. 1, 11-12, and 15-16, the lacing slots 5 can be arranged to secure the second end of the strap 3, i.e., the lacing end 14 of the strap 3, to the rigid plate 2. That is, the lacing slots 5, for example, can be configured such that weaving the lacing end 14 of the substantially flat strap 3 through the lacing slots 5 secures the laced end of the substantially flat strap 3 to the recessed region 6 of the rigid plate 2. The length of the strap 3, however, remains adjustable as described herein.

Because of the configuration of the lacing slots 5, a user can adjust the length of the central portion 4 of the strap 3 extending over the front side 15 of the rigid plate 2 by pulling or loosening the lacing end 14 of the substantially flat strap 3 extending through the lacing slots 5. That is, while the lacing slots 5 of the rigid plate 2 can secure the strap 3 to the rigid plate 2, the lacing slots 5 are configured so that the strap can be pulled through the lacing slots 5 in either direction, while maintaining enough friction on the strap 3 so that the lacing end 14 of the strap 3 can be secured to the recessed region 6 of the rigid plate 2. As such, adjusting the strap 3 allows for tightening or loosening the strap, which thereby permits the user to adjust the volume of personal items the wallet 1 may accommodate. For example, the user may shorten the central portion 4 of the strap 3 extending around the front of the rigid plate 2 by pulling on the lacing end, thereby tightening the strap 3 relative items in the wallet 1.

Because the length of the central portion 4 of the strap can be adjusted, the user can select the amount of tension applied to the contents of the wallet 1 by the strap. For example, if the user desired to increase the amount of tension applied to the contents of the wallet by the strap 3, the user can pull on the lacing end 14 of the strap, thereby shortening the length of the central portion 4 of the strap. This can increase the tension applied to the contents of the wallet by the strap 3 and allow the contents of the wallet to be secured more tightly. In another example, if the user desired to decrease the amount of tension applied to the contents of the wallet by the strap 3, the user can unthread a portion of the lacing end 14 of the strap from the lacing slots, thereby increasing the length of the central portion 4 of the strap. This can decrease the tension applied to the contents of the wallet by the strap 3 and allow the contents of the wallet to be more easily removed.

In certain example embodiments, a metal rigid plate 2 may provide Radio Frequency Identification (RFID) blocking. For example, certain credit cards or personal identification cards include embedded RFID chips containing personal information. When the rigid plate 2 is constructed of metal, for example, the rigid plate 2 may block unauthorized access to the RFID-based chip, thereby preventing theft of the user's personal credit card information or other personal information. Additionally or alternatively, RFID blocking may be enhanced or achieved by inserting a metal card, such as a metal card shaped like a credit card, into the wallet 1 as described herein. For example, a user may insert personal items into the wallet 1, and then insert the metal card (or second plate) on the outside personal items such that the personal items are sandwiched between the card or plate and a metal rigid plate 2. Having metal on both sides of any personal items containing an RFID chip, for example, enhances or achieves RFID blocking with the wallet as described herein.

By configuring the wallet 1 in accordance with the example embodiments described herein, a low profile and durable wallet is provided. The wallet 1 is also easy to use, lightweight, and durable. And, when desired, the wallet 1 may also provide RFID blocking.

In view of the many example embodiments to which the principles of the disclosed invention may be applied, it should be recognized that the illustrated embodiments are only preferred examples of the invention and should not be taken as limiting the scope of the invention. Rather, the scope of the invention is defined by the following claims. We therefore claim as our invention all that comes within the scope and spirit of these claims.

What is claimed is:

1. A wallet, comprising:

a strap having a first end, a second end, and a central portion extending between the first end and the second end; and a plate having a front side, defining an interior opening, defining an anchoring slot, and having a lacing region defining a plurality of lacing slots, wherein the lacing region is suspended within the interior opening by one or more connectors that extend the lacing region rearward from a horizontal plane defined by the front side of the plate, thereby the lacing region forming an area of depression of the plate;

wherein the first end of the strap is anchored to the plate through the anchoring slot, the central portion of the strap extends around the plate, and the second end of the strap is laced through the lacing slots, thereby securing the strap to the plate and defining an interior compartment between the strap and the plate.

2. The wallet of claim 1, wherein the plurality of lacing slots are parallel to each other and parallel to a central longitudinal axis of the plate.

3. The wallet of claim 1, wherein the plate is a metal plate.

4. The wallet of claim 1, wherein the first end of the strap is wider and/or thicker than a width and/or a thickness of the anchoring slot such that the first end cannot pass through the anchoring slot.

5. The wallet of claim 4, wherein the first end of the strap comprises a cap.

6. The wallet of claim 4, wherein the first end is folded upon the strap and secured thereto by a fastening means.

7. The wallet of claim 1, wherein the length of the central portion of the strap extending around the plate is adjustable.

8. The wallet of claim 7, wherein pulling the second end of the strap through the plurality of lacing slots shortens the length of the central portion of the strap extending around the plate.

9. The wallet of claim 1, wherein the interior compartment is configured to hold a credit card and/or paper money.

10. The wallet of claim 1, wherein the plate comprises an RFID-blocking material.

11. The wallet of claim 1, wherein the plate further comprises a first sidewall and a second side wall extending from adjacent sides of the plate in a direction outward from the front side of the plate, thereby defining boundaries of the interior compartment.

12. The wallet of claim 1, wherein the strap is a nylon strap.

13. The wallet of claim 12, wherein the strap is non-elastic.

14. The wallet of claim 1, wherein adjustment of the second end of the strap adjusts the amount of tension applied to contents of the wallet by the central portion of the strap.

15. The wallet of claim 1, wherein the lacing region is recessed rearward relative to the plate, thereby placing the plurality of lacing slots in a different plane than the plate.

16. The wallet of claim 15, wherein the lacing region is in a plane substantially parallel to the front side of the plate.

* * * * *